US006041612A

United States Patent [19]

Stringer

[11] Patent Number: 6,041,612

[45] Date of Patent: Mar. 28, 2000

[54] REFRIGERATION COIL BRUSH AND METHOD

[76] Inventor: Steven C. Stringer, 355 Kings Ridge Rd., Randleman, N.C. 27317

[21] Appl. No.: 09/157,298

[22] Filed: Sep. 18, 1998

[51] Int. Cl.[7] ..... F28G 23/00

[52] U.S. Cl. ..... 62/303; 165/95

[58] Field of Search ..... 62/303; 165/95

[56] References Cited

U.S. PATENT DOCUMENTS

| | | | |
|---|---|---|---|
| 4,402,360 | 9/1983 | Baron et al. | 165/76 |
| 4,497,363 | 2/1985 | Heronemus | 165/95 |
| 4,592,417 | 6/1986 | Baron | 165/95 |
| 4,777,804 | 10/1988 | Bowling et al. | 62/85 |
| 5,211,028 | 5/1993 | Remo | 62/303 |
| 5,226,285 | 7/1993 | Dankowski | 62/184 |
| 5,279,357 | 1/1994 | Kennon et al. | 165/95 |

*Primary Examiner*—Henry Bennett
*Assistant Examiner*—Mark Shulman

[57] ABSTRACT

This invention is drawn to a brush which cleans dust and debris from refrigeration coils in conventional coolers. When the door is opened, a cable draws a brush upwardly across the face of the condenser coil and removes dust from the coil. The brush is attached to a jointed arm which controls the positioning of the brush and keeps the brush contiguous the coil. A method of operating the device is also disclosed.

14 Claims, 7 Drawing Sheets

REFRIGERATION COIL BRUSH AND METHOD

BACKGROUND OF THE INVENTION

1. Field of the Invention

This invention pertains to a brush for removing dust from between the fins of a condenser on a refrigeration unit.

2. Description of the Prior Art and Objectives of the Invention

Drink filled coolers have become common in convenience stores across the country. These typically include a hinged glass door which displays the various beverages located inside. Such coolers include conventional finned refrigeration/condenser coils in order to keep the beverages at a desired drinking temperature. These refrigeration coils accumulate dust and debris thereon, which gathers at the intersections of the fins and the coil precluding efficient heat dissipation. Extended intervals of operation with such dust accumulation frequently burns out the compressor resulting in a service call as well as the potential for spoiled or otherwise unsalable beverages.

A number of devices have been proposed which act to eliminate this dust accumulation including those disclosed in U.S. Pat. Nos. 5,211,028 and 4,497,363. While effective for removing dust, these devices are bulky and tend to get in the way of the cooler door operation. Likewise, the '028 device must be manually operated by means of a lever.

Thus with the limitations of the aforedescribed devices in mind, it is an objective of the present invention to provide a brush which automatically cleans dust from a refrigeration coil upon each opening and closing of the cooler door.

It is a further objective of the present invention to provide a brush which is sized so as to fit within conventional beverage coolers.

It is still a further objective to allow unrestricted air flow through the brush and condenser of the cooler despite the mounting the brush on the coil.

It is yet a further objective to provide a brush which is generally mounted to the side of the condenser rather than on the condenser itself.

It is another objective to provide a brush which does not catch or hang on the coils during operation.

It is yet another objective to provide a motor actuated brush which cleans the condenser without manual intervention.

It is still another objective to provide a method of cleaning or removing dust from refrigeration coils using the present invention.

These and other objectives and advantages will become readily apparent to those skilled in the art upon reference to the following detailed description and accompanying drawing figures.

SUMMARY OF THE INVENTION

The aforesaid objectives and advantages are realized by positioning a brush across the width of a conventional finned condenser coil. The bristles of the brush extend between the fins to wipe dust from the intersections of the fins and coil as the brush is drawn upwards across the face of the condenser. In the preferred embodiment, a cable is attached to the brush, wherein the cable extends through a series of pulleys and is ultimately attached to the door of the cooler. While the preferred cooler is a beverage cooler, the present invention may be adapted to any number of coolers which contain a conventional condenser coil. The brush is rigidly affixed to a jointed arm and extends perpendicularly from the arm across the coil. Extending from the end of the brush is a wheel or roller which engages a vertical member.

The jointed arm includes a first portion and a second portion. The first portion is pivotally attached to a horizontal member and also pivotally attached to the second portion, thus forming a "shoulder" joint and an "elbow" joint in the arm. The horizontal member is rigidly affixed to the wheel engaged vertical member. A spring extends between the horizontal member and the second portion of the jointed arm, biasing the arm into an inactive position.

When the cooler door is opened, the cable preferably pulls the brush upwardly across the face of the coil, thereby removing dust from the same. When the cooler door is closed, the cable relaxes, and the spring contracts, thereby drawing the brush downward to its inactive position. Thus, the brush does not normally interfere with the flow of air across the fins or condenser coil, and since the jointed arm is to the side of the condenser coil, the apparatus does not take up space in front of the coil and fits within most conventional coolers.

An electric motor may also be provided to periodically operate the brush if desired for coolers which do not see regular use and thus are not opened/closed frequently enough to effectively and timely remove the dust from the coil.

DETAILED DESCRIPTION OF THE PREFERRED EMBODIMENTS AND OPERATION OF THE INVENTION

Figure 1:
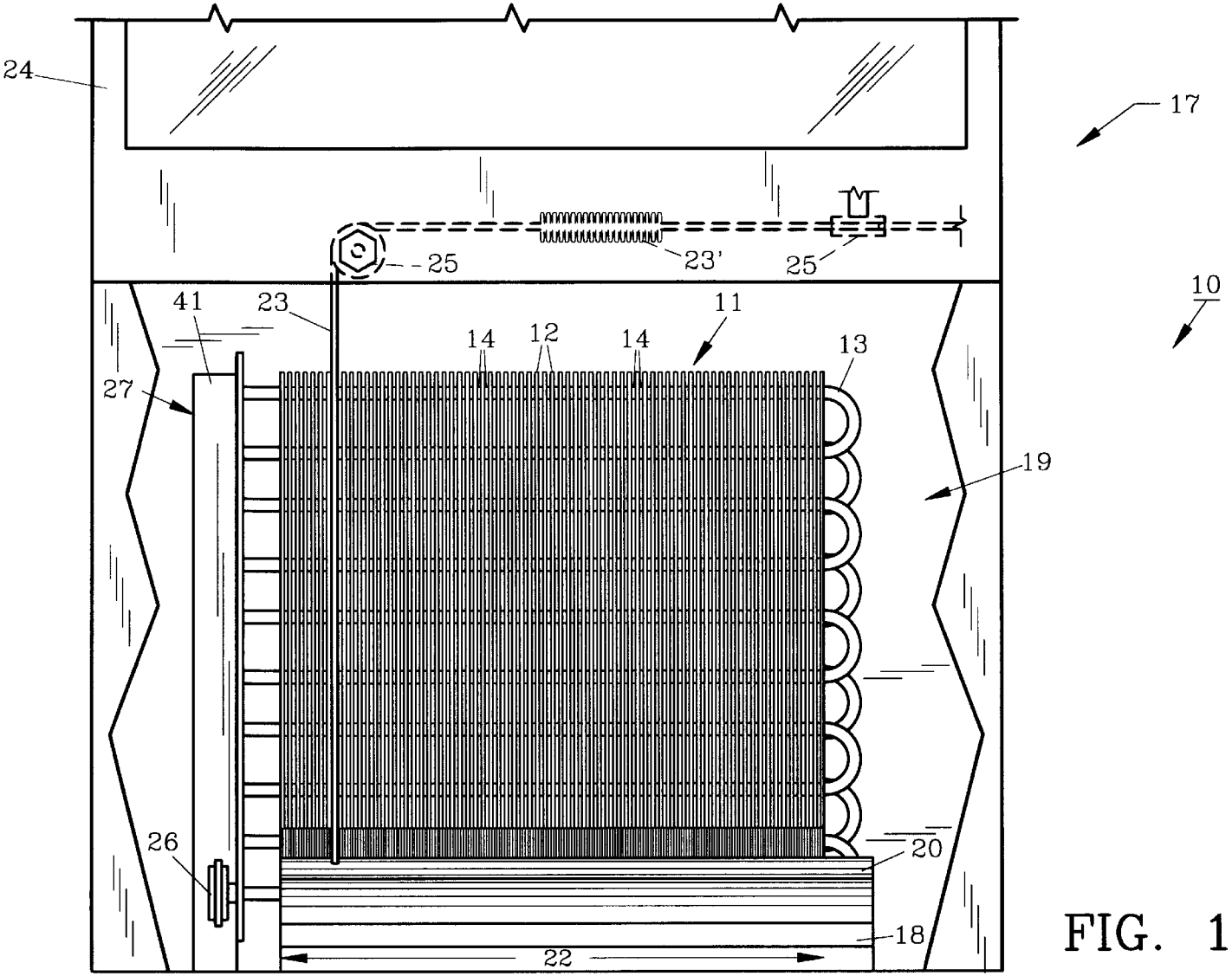
FIG. 1 shows a front elevational view of the preferred embodiment of the present invention positioned in a cooler which has been fragmented for clarity.
Figure 2:
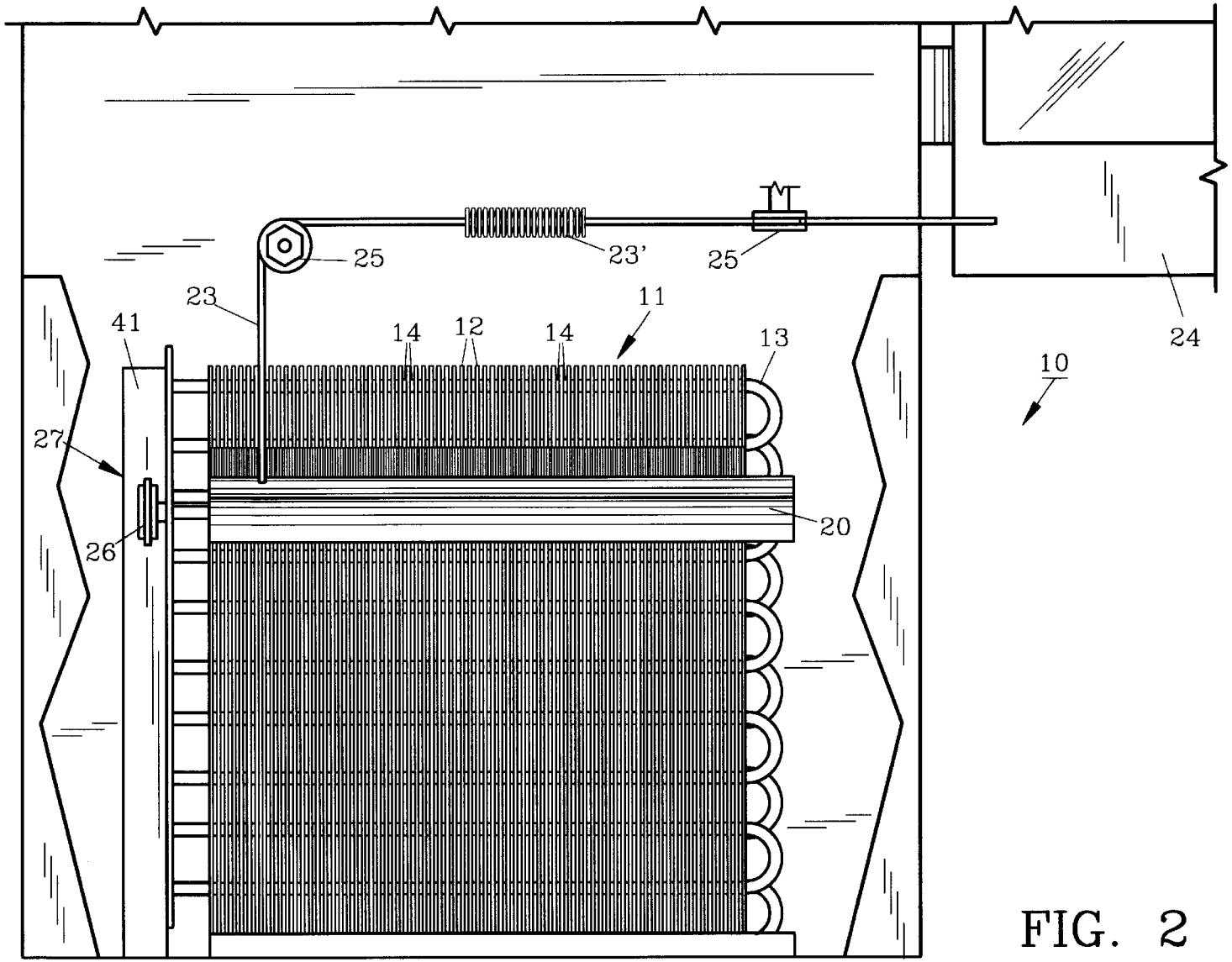
FIG. 2 illustrates the apparatus of FIG. 1, with the cooler door in the open position.
Figure 3:
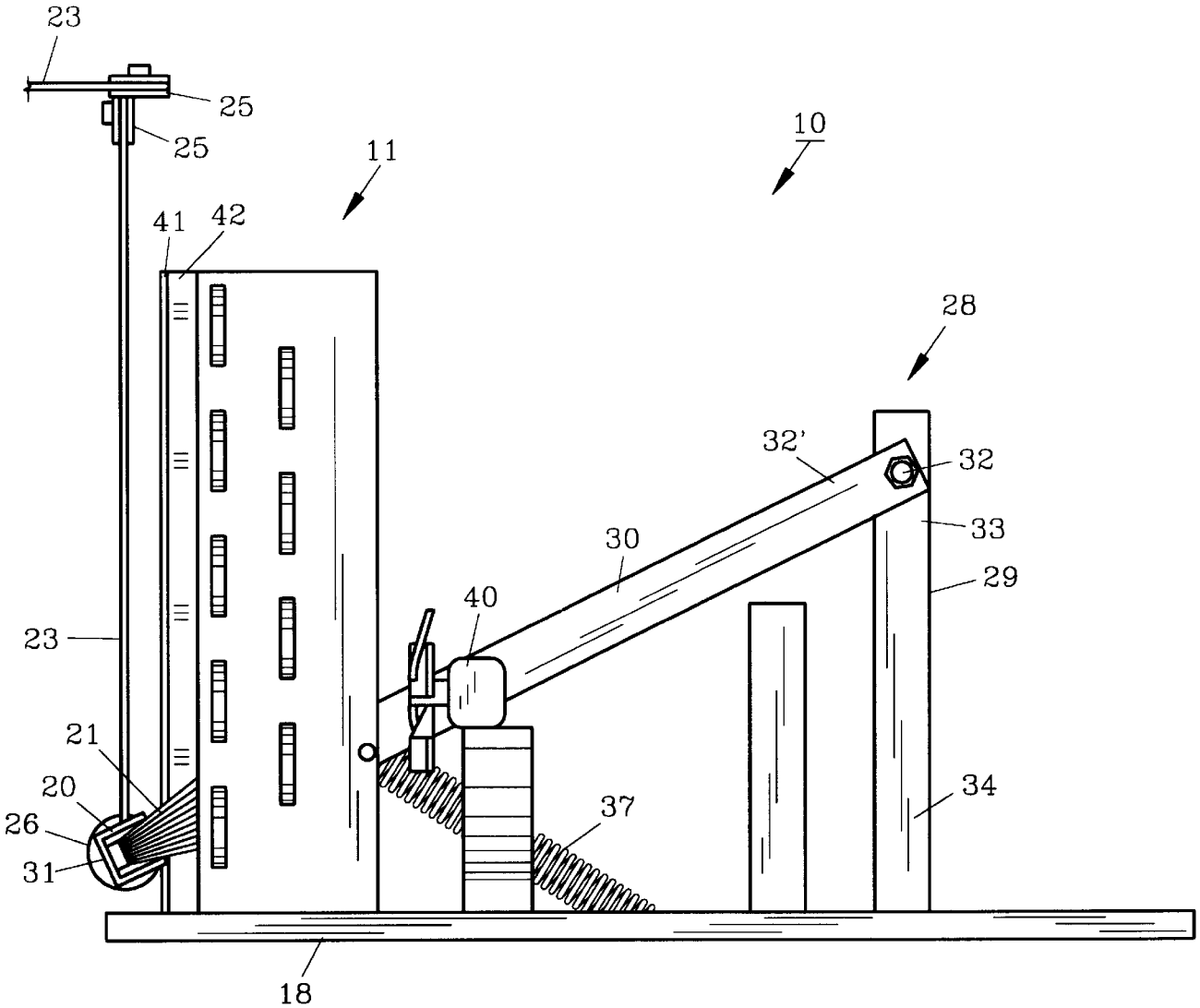
FIG. 3 depicts a right side elevational view of the apparatus of FIG. 1 removed from the cooler.

Turning now to the drawings, specifically FIGS. 1–4 show preferred coil cleaning apparatus 10 positioned within conventional beverage cooler 17 on conventional condenser coil 11, which includes fins 12 and refrigerant containing tube 13 (FIG. 1). Coil 11 rests on floor 18 of cooler 17 within chamber 19. Dust normally accumulates at intersections 14, but may also cling to both fins 12 and tube 13. Brush rod 20 is positioned below and in front of coil 11 and holds brush 21 thereagainst (FIG. 3). Brush 21 extends the width of coil 11 as indicated by arrow 22 (FIG. 1). Brush rod 20 is connected by cable 23 to hinged door 24. Cable 23 is held in place by a plurality of pulleys 25 and may include cable spring 23' to allow for different lengths between brush rod 21 and hinged door 24. When door 24 is opened, as seen in FIG. 2, cable 23 is pulled, thereby drawing brush rod 20 upwardly. Wheel or roller 26 rolls along vertical member 27, and brush 21 sweeps across fins 12 and tube 13 removing dust therefrom. Vertical member 27 is preferably an L-shaped piece of angle iron. Wheel or roller 26 rolls on face 41 of vertical member 27.

Figure 4:
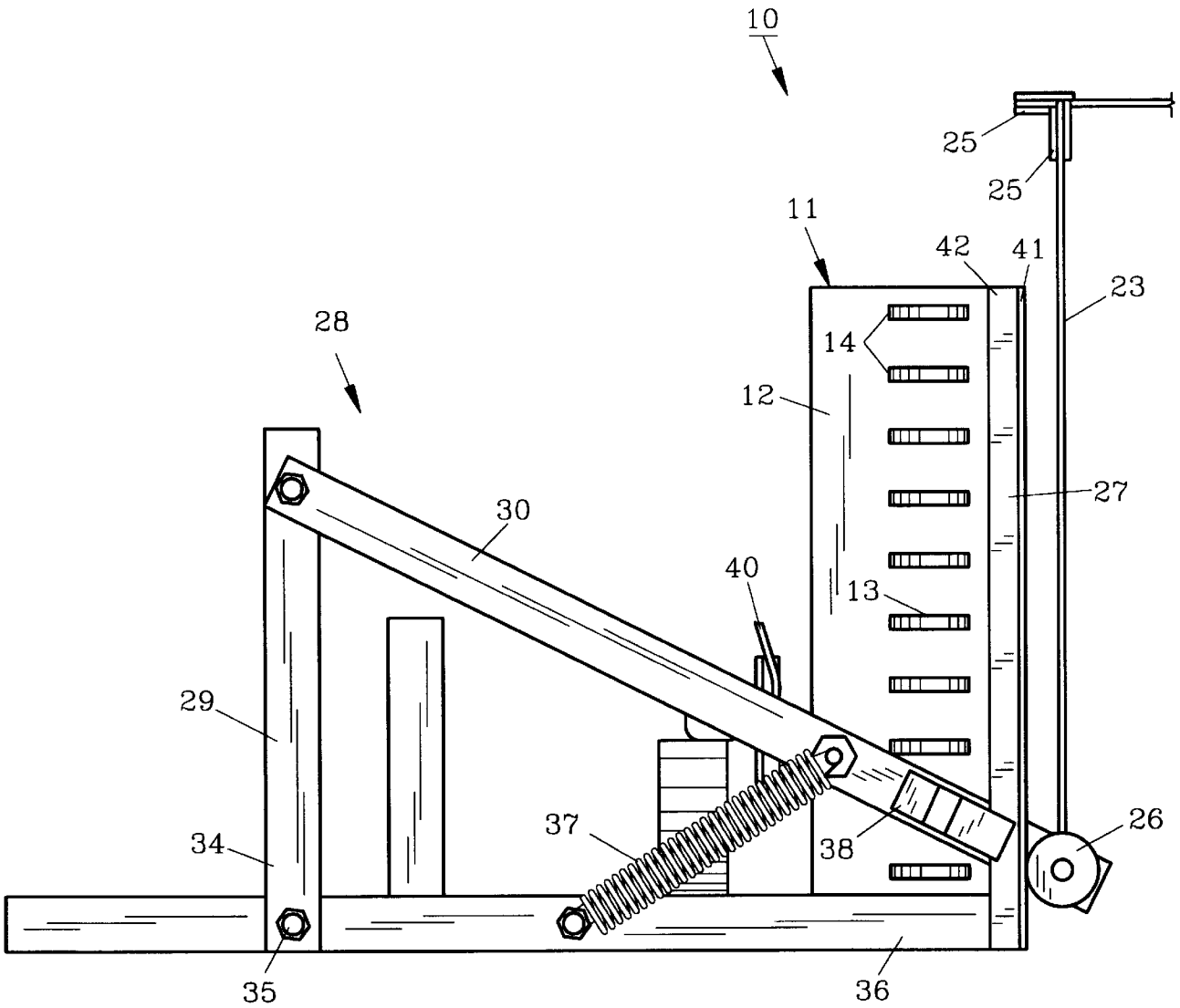
FIG. 4 demonstrates a left side elevational view of the apparatus of FIG. 1 removed from the cooler.

As better seen in FIGS. 3 and 4, brush rod 20 is rigidly affixed to jointed arm 28 which comprises first portion 29 and second portion 30 (FIG. 3). Brush rod 20 is affixed to distal end 31 of second portion 30. Pivot connection 32 attaches proximal end 32' of second portion 30 to distal end 33 of first portion 29. In FIG. 4, proximal end 34 of first portion 29 is pivotally attached by pivot connection 35 to horizontal member 36, which is in turn rigidly, perpendicularly affixed to vertical member 27. With the exception of cable 23 and brush 21, all recited components are preferably rigid metal. Spring 37 attaches second portion 30 to horizontal member 36 and biases jointed arm 28 in its inactive, lowered position (FIGS. 1, 3 and 4). It is preferred that jointed arm 28 be positioned to the side of coil 11 so that only brush rod 20 and brush 21 are positioned over the face of coil 11. This effectively keeps apparatus 10 small and thus easy to install in conventional coolers. Nor does it interfere with the functioning of fan 40 (FIG. 3). In addition to roller 26 engaging vertical member 27, j-shaped member 28 fits around leg 42 of vertical member 27, sandwiching leg 42 between j-shaped member 42 and second portion 30 of jointed arm 28.

Figure 5:
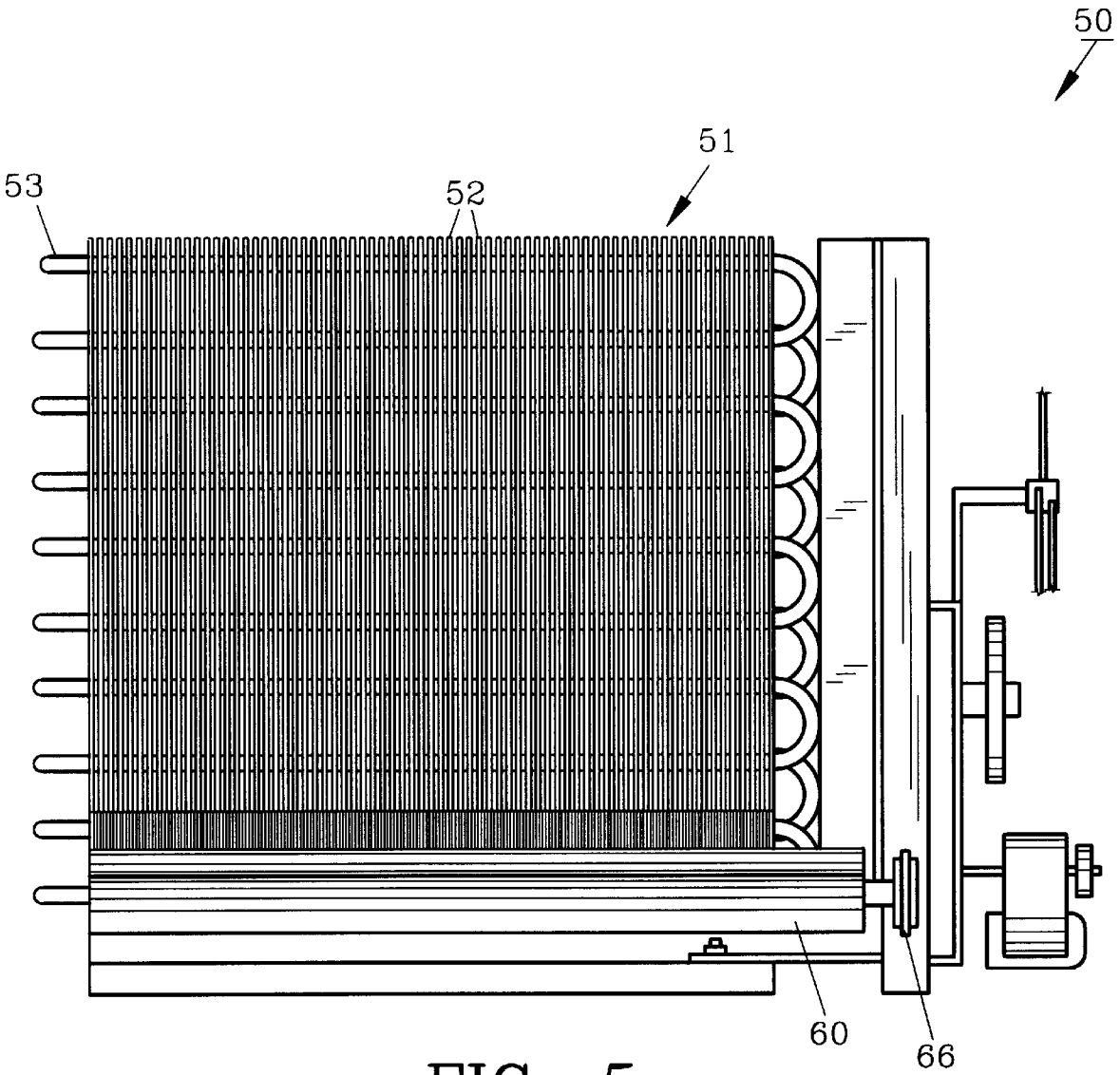
FIG. 5 features a front elevational view of an alternate embodiment of the present invention.
Figure 6:
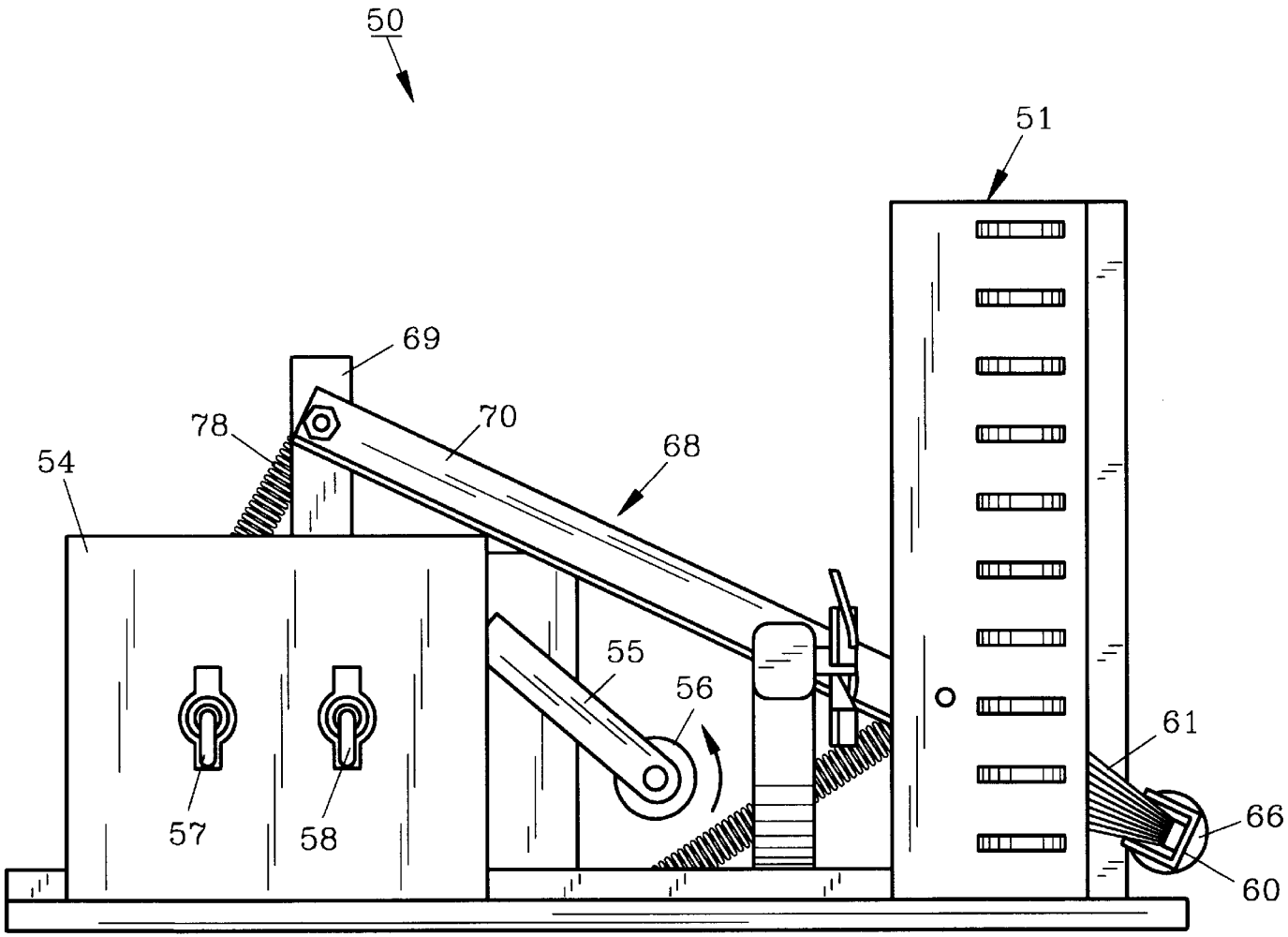
FIG. 6 pictures a left side view of the apparatus of FIG. 5.
Figure 7:
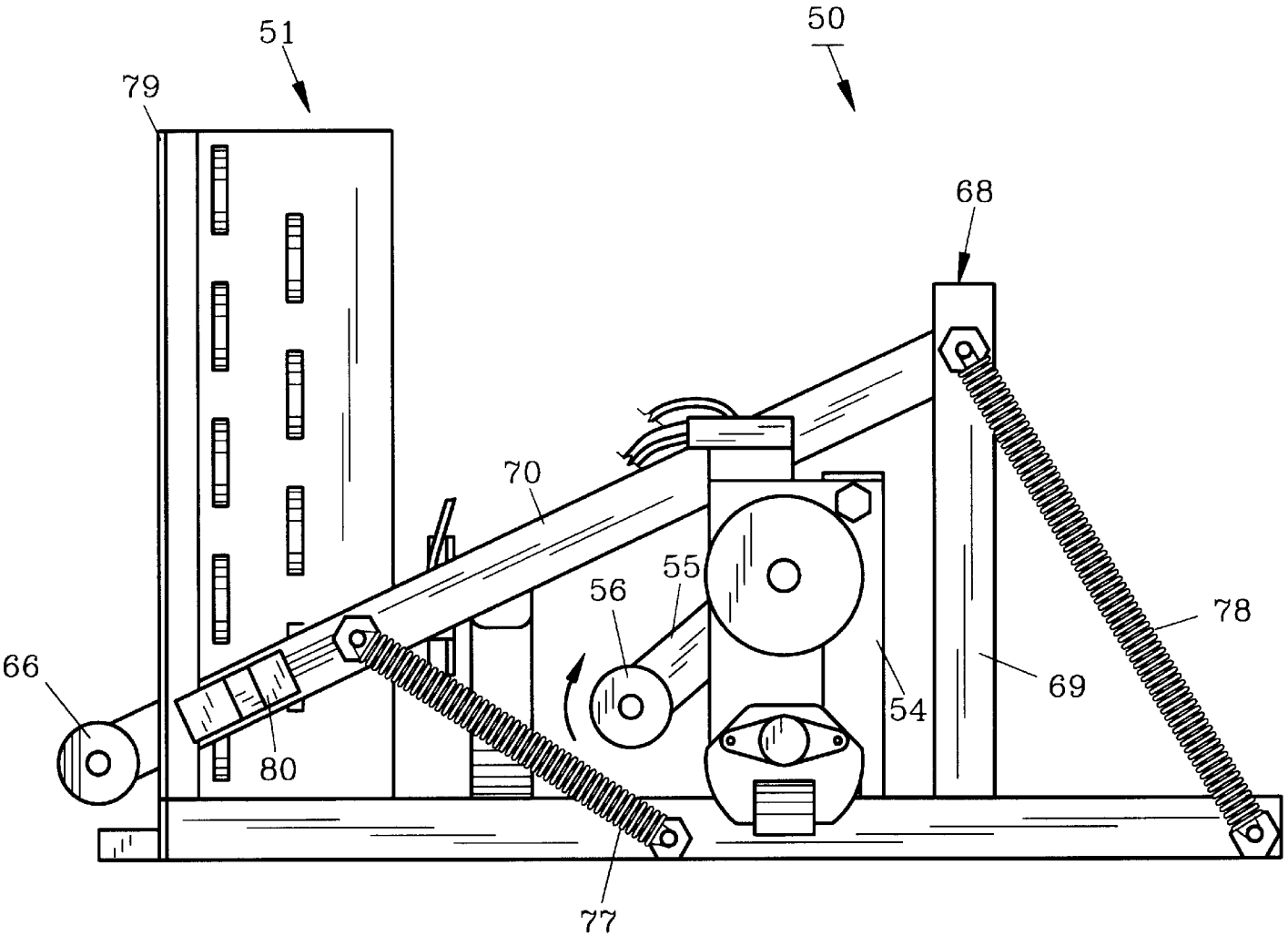
FIG. 7 depicts a right side view of the apparatus of FIG. 5.

Alternate apparatus 50 is seen in FIGS. 5–7. Specifically, brush rod 60 is positioned in front of conventional condenser coil 51 with fins 52 and tube 53, much like condenser 11 (FIG. 5). Brush 61 (FIG. 6) cleans coil 51 like brush 21 cleans condenser coil 11. Jointed arm 68, with first portion 69 and second portion 70 is identical to jointed arm 28. However, instead of cable 23 attached to hinged door 24, jointed arm 68 is moved by arm 55 and roller 56 which are controlled by electric motor 54. Motor 54 may be operated by switches 57 and 58, which are shown as toggle switches, but are symbolic of conventional door light switches, such as used in household refrigerators or activated by a thermostatic switch which turns on the compressor. Motor 54 raises and lowers arm 55. Roller 56 engages second portion 70 and urges jointed arm 68 upwardly, thus drawing brush 61 across coil 51. Additionally spring 78, along with spring 77 bias jointed arm 68 in a downward posture. J-shaped member 80 and wheel 66 ride on vertical member 79 much like j-shaped member 38 and wheel 26 ride on vertical member 27.

The preferred method of using apparatus 10 comprises installing apparatus 10 generally as shown. Then, cooler 17 is stocked with beverages (not shown) and electrical power is supplied to the cooler to chill the same. When a customer or user wishes a drink, he or she opens door 24, thereby pulling cable 23 through and around pulleys 25 thereby pulling on brush rod 20. Jointed arm 28 allows brush rod 20 to move upwardly, drawing brush 21 across coil 11 and cleaning the same. Wheel 26 rides on vertical member 27 and j-shaped member 38 does the same to keep brush rod 20 properly positioned across the width of coil 11. After retrieval of the desired beverage or item from the cooler, the user then shuts door 24. This allows cable 23 to relax and spring 37 contracts to pull jointed arm 28 into its inactive position (FIG. 1).

Alternatively, if motor 54 is used, motor 54 may be connected to a timer (not shown) and motor 54 will raise arm 55 to move jointed arm 68 upwardly thereby drawing brush 61 across coil 51, cleaning the same. Arm 55 will be lowered and springs 77 and 78 will draw arm 68 into its inactive position.

It should be noted that with the present configuration, little space is used in "front" of coil 11 or 51 and thus, apparatus 10 or 50 will easily fit in most conventional coolers. This is in contrast to some of the prior art devices which include configurations ill suited to positioning within pre-existing coolers.

The preceding recitation is provided as an example of the preferred embodiment and is not meant to limit the nature of scope of the present invention or appended claims.

I claim:

1. In an apparatus comprising a refrigeration coil, the improvement comprising:

a) a first vertical member;

b) an arm, said arm comprising a first generally vertical portion and a second generally horizontal portion, said first portion pivotally connected to said second portion, said arm slidably engaging said first vertical member;

c) a wheel, said wheel attached to said arm and rollingly engaging said first vertical member; and d) a brush, said brush attached to said second portion whereby said arm slides along said first vertical member drawing said brush across said coil to remove dust therefrom.

2. The apparatus of claim 1 further comprising a horizontal member, said horizontal member attaching said first portion of said arm to said first vertical member.

3. The apparatus of claim 2 further comprising a spring, said spring connecting said arm to said horizontal member.

4. The apparatus of claim 1 wherein said brush spans the width of said coil.

5. The apparatus of claim 1 further comprising a cable, said cable attached to said brush for moving the same.

6. In a refrigerator with a door and a refrigeration coil, the improvement comprising:

a) a brush;

b) means to move said brush across said coil when said door opens and closes to thereby remove dust from said coil, said moving means attached to said brush.

7. The refrigerator of claim 6 wherein said moving means comprises a cable, said cable connecting said door to said brush.

8. The refrigerator of claim 6 wherein said moving means comprises a jointed arm, said arm attached to said brush.

9. The refrigerator of claim 6 further comprising a vertical member, said brush slidably engaging said vertical member.

10. The refrigerator of claim 9 further comprising a wheel, said wheel rollingly engaging said vertical member.

11. The refrigerator of claim 10 further comprising a jointed arm; and horizontal member, said horizontal member connecting said jointed arm to said vertical member.

12. A method of cleaning a refrigeration coil, said method comprising the steps of:

a) opening the door of a refrigeration unit;

b) pulling a cable connecting the door to a brush proximate the coil; and c) drawing the brush across the coil to remove dust therefrom.

13. The method of claim 12 further more comprising the step of providing a jointed arm attached to said brush.

14. The method of claim 13 further comprising the step of restoring said brush to its original position by pulling on said jointed arm.

* * * * *